United States Patent [19]

Shames et al.

[11] 4,221,337

[45] Sep. 9, 1980

[54] AERATOR AND SPRAY COMBINATION

[76] Inventors: Sidney J. Shames, 57 Holly Pl., Briarcliff Manor, N.Y. 10510; Harold Shames, 5 Agnes Cir., Ardsley, N.Y. 10502

[21] Appl. No.: 4,062

[22] Filed: Jan. 17, 1979

[51] Int. Cl.[2] ..... B05B 1/16

[52] U.S. Cl. ..... 239/428.5; 137/625.48; 239/447; 239/449

[58] Field of Search ..... 239/432, 443–449, 239/428.5, 25, DIG. 18; 137/801, 872, 625.48

[56] References Cited

U.S. PATENT DOCUMENTS

| | | | |
|---|---|---|---|
| 3,524,591 | 8/1970 | Samuels et al. | 239/428.5 |
| 3,684,191 | 8/1972 | Shames et al. | 239/428.5 |
| 3,902,671 | 9/1975 | Symmons | 239/428.5 |

*Primary Examiner*—Robert W. Saifer
*Assistant Examiner*—Michael J. Forman
*Attorney, Agent, or Firm*—Norman Lettvin

[57] ABSTRACT

An improved faucet spout attachment is provided for selectively delivering therefrom either an aerated stream or a spray of liquid. The attachment is inexpensively manufactured and provided by an adapter and a body member. The adapter is shaped to provide thereon both an upstream annular head and a reduced diameter downstream nipple. The adapter's nipple has its exit passageway only in the nipple's longitudinal wall. Two seals are provided on the nipple both up-stream and downstream of the exit passageway. A seal is provided on the adapter's annular head. The body member is axially elongated and constructed to slidingly cooperate with both the head and nipple of the adapter to provide two liquid tight seals at alternate axial positions for the body member. The body member is shiftable axially between two operative positions that establish alternate paths of flow from the body member, one of which produces a spray while the other path leads to a discharge opening in which an aerator is positioned.

5 Claims, 4 Drawing Figures

AERATOR AND SPRAY COMBINATION

FIELD OF THE INVENTION

This invention relates to an improvement in an aerator-or-spray attachment for a faucet spout and more particularly relates to a relatively inexpensive attachment for delivering either an aerated stream or a spray of liquid from a faucet or other source of liquid under pressure.

BACKGROUND OF THE INVENTION

Faucet attachments for selectively delivering either an aerated stream or spray of pressurized water are known in the art. However, past constructions have been relatively expensive or have failed to effect the requisite tight seals between internal parts, thereby permitting undesirable leakage of liquid which impairs efficiency of operation. The known prior constructions also fail to provide for ease in manual manipulation of the attachment to effect selection of the desired type of liquid flow.

Therefore, it is one object of this invention to provide an improved aerator-or-spray attachment that is constructed principally of molded plastic parts, thereby attaining inexpensiveness of manufacture, while securing and preserving reliability and effectiveness of operation.

Another object of this invention is to provide an aerator-or-spray attachment having therein special seal arrangements to preclude leakage of liquid.

Still a further object of this invention is to provide an aerator-or-spray attachment, having an easily manipulatable body member for selecting, through axial movement, the desired alternate type of liquid flow therefrom.

Other objects and advantages of the invention will become clear to one skilled in the art from the following description of preferred embodiments of the invention.

BRIEF SUMMARY OF THE INVENTION

An aerator-or-spray attachment for a faucet spout or other source of liquid under pressure is constructed using an adapter and a body member that cooperate in a manner to achieve two alternate paths of liquid flow from the body member, while avoiding leakage between the parts and reducing cost of manufacture.

The adapter is provided with an upstream, large diameter head portion and a downstream, smaller diameter, elongated nipple portion with flow passageway means only through the longitudinal wall of the elongated nipple portion. Two annular seals are placed on the downstream nipple portion spaced axially on opposite sides of the flow passageway means. An annular body member surrounds the nipple and is selectively shiftable axially between a first position of sealing engagement with the upstream seal means and a second position of sealing engagement with the downstream seal means so that fluid issuing from the flow passageway means in the nipple portion discharges from the body member along alternate paths defined in the body member. An aerator is secured to the body member for receiving flow from one of the alternate flow paths, while the other alternate flow path includes a series of spray jets annularly arranged. A reliable and leak-proof construction is produced which also uses the head of the adapter and the body member for limiting movement of the body member in its upstream and downstream directions. The aerator may be secured to the body member by alternate constructions.

The inventions will be better understood by reference to the following detailed description when considered in connection with the accompanying drawings, in which like reference numerals designate like parts throughout the figures thereof.

DETAILED DESCRIPTION OF THE INVENTION

Figure 1:
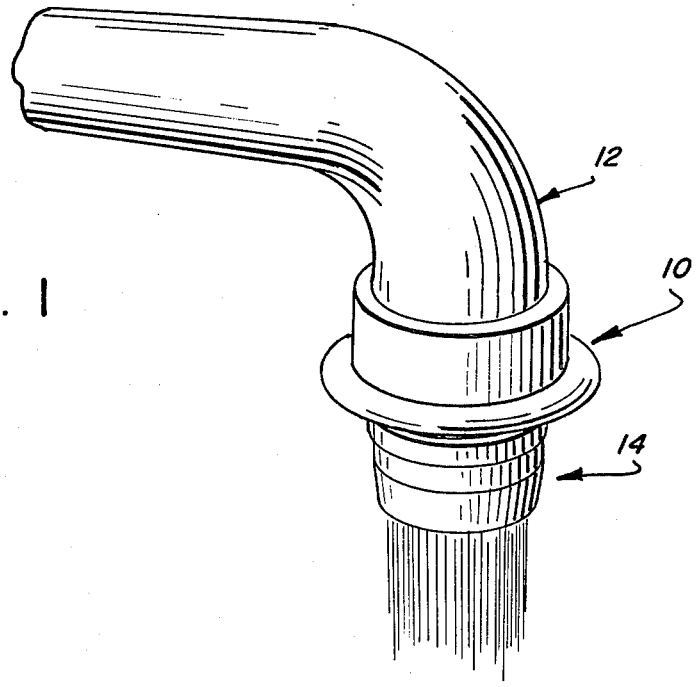
FIG. 1 is a fragmentary perspective view of the discharge end of a faucet spout with the device of this invention attached thereto, and delivering an aerated flow therefrom.

Referring now to the drawings, the aerator-or-spray attachment of this invention is shown in FIG. 1 generally at 10 connected to the discharge end of a water faucet spout 12 or other source of liquid under pressure. The attachment 10 includes an aerator 14 at its downstream end.

Figure 2:
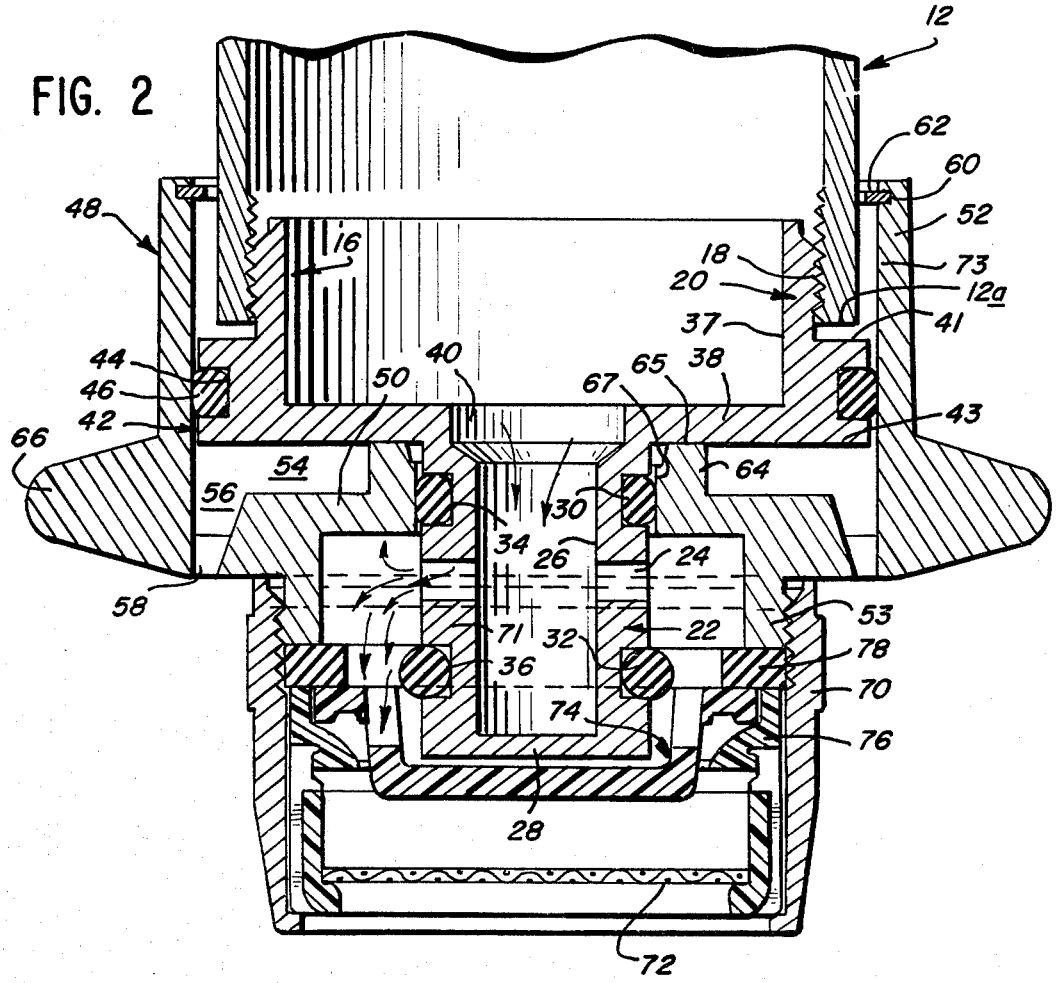
FIG. 2 is a greatly enlarged, vertical cross-sectional view taken in a plane through the longitudinal axis of the device of this invention, and showing the body member and adapter, with the body member in sealing engagement with the upstream seal on the adapter's nipple.
Figure 3:
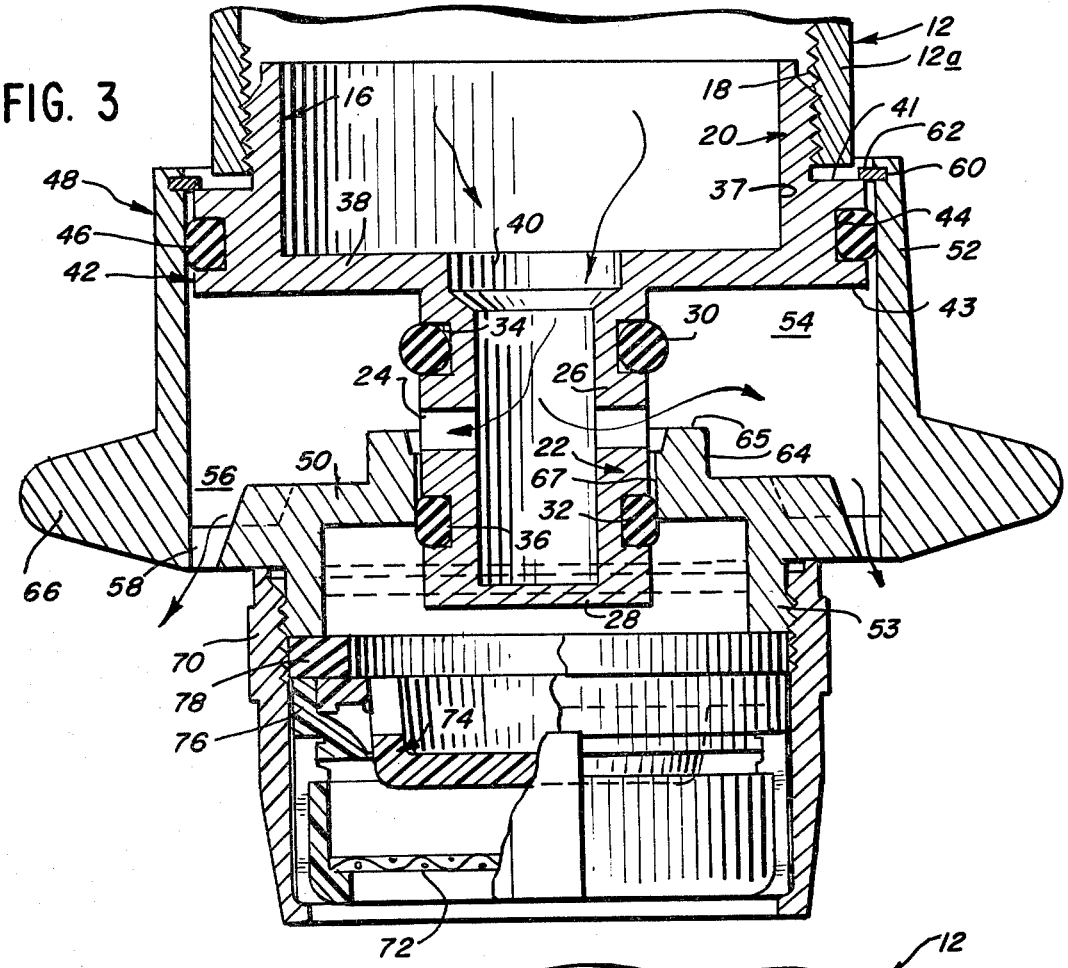
FIG. 3 is a view similar to FIG. 2 but showing the body member in sealing engagement with the downstream seal on the adapter's nipple.

Referring to FIGS. 2 and 3, the faucet spout 12 is shown female threaded and an adapter 16 is threadedly attached as at 18 to the discharge end of faucet 12. The adapter is a molded plastic part and has an upstream, large diameter head portion 20 and a downstream, smaller diameter nipple portion 22. Smaller diameter nipple portion 22 is axially elongated and includes flow passageway means formed in a longitudinal wall 26 comprising a plurality of apertures such as 24. The bottom wall 28 of smaller diameter nipple portion 22 is imperforate.

Two O-rings 30 and 32, serving as seal means on nipple 22, are positioned in annular grooves 34 and 36, formed in the outer periphery of nipple wall 26. These seal means 34 and 36 extend radially outwardly of the outer periphery of nipple wall 26 and are spaced axially, respectively upstream and downstream of the flow passageway means 24.

The upstream, large diameter head portion 20 of adapter 16 is formed with an interior longitudinal wall 37 and a tranverse bottom wall 38. The transverse bottom wall 38 has a centrally located bore 40 forming a path for fluid from the discharge faucet end, through the upstream, large diameter head portion 20 into the downstream, smaller diameter, nipple portion 22 and exiting from the longitudinal wall apertures 24.

A flange 42 having a top wall 41 and a bottom wall 43 extends radially outward from the lower end of the adapter's head portion 20 and radially outwardly of the terminus **12*a* of faucet spout 12. A third O-ring 46 is positioned in an annular groove 44 formed in the outer periphery of flange 42 and extends outwardly of flange 42** to be sealingly engaged as hereinafter described.

A body member, generally shown at 48, surrounds adapter 16 to cooperate therewith. Body member 48 is a molded plastic part that includes an annular main body portion, or radially elongated transverse wall, 50 having an axially elongated, upstream extending outer sleeve 52 formed proximate the outer edge of portion 50 and a downstream extending attachment sleeve 53. The attachment sleeve is threaded to have attachment thereto a flow appliance such as an aerator. As shown, sleeve 53 is male threaded to receive the female threaded casing of an aerator of well known construction.

An annular space, or chamber, 54 is defined between transverse bottom wall 38 of the adapter 16 and transverse wall 50 of the body member 48. Chamber 54 communicates through a tapered annular channel 56 to a spray means consisting of a plurality of discrete outlet apertures 58 in body member 48 arranged in an annular configuration.

A groove 60 is formed in the interior surface adjacent the upper end of outer sleeve 52, said groove 60 receiving therein a C-ring 62. The C-ring extends radially inward of the inner periphery of outer sleeve 52. An inner portion of the transverse wall 50 projects upwardly to form an inner sleeve 64 having a top contact edge 65 and an axially elongated inner cylindrical sealing wall 67. A manually graspable, enlarged, annular control ring 66 humps outward radially adjacent the lower end of outer sleeve 52.

The operation of the body member 48 when placed in operative position to encircle the adapter 16 will now be understood. Control ring 66 may be moved upwardly into a first position by selectively sliding it upwardly to the position shown in FIG. 2, until the top contact edge 65 of sleeve 64 engages the transverse bottom wall 38 of the adapter 16. At the same time sealing wall 67 slides over and compresses the upstream O-ring 30 to effect a liquid tight seal, while outer sleeve 52 is at all times sliding against and effecting a compression seal with O-ring 46.

Alternatively, control ring 66 may be moved downstream into its second position, that shown in FIG. 3, by moving ring 66 downwardly until the inwardly extending C-ring 62 contacts top wall 41 of flange 42, to thereby halt downstream movement of the body member 48. This action brings the cylindrical sealing wall 67 into compressive sealing engagement with the downstream O-ring 32, while outer sleeve 52 slides over O-ring 46 but remains in compressive sealing relation therewith.

The aerator 14 that is to be secured to attachment sleeve 53 of body member 48 may be of any well known construction. In the specific embodiments shown herein, the aerator is of the general type shown in FIG. 5 of U.S. Pat. No. 3,684,191 and described therein. Such aerator includes a female threaded casing 70 with screen means 72 adjacent the discharge end. The upstream end of the aerator includes a cup shaped part 74 supported in a molded plastic annulus 76 and with a resilient upstream sealing washer 78. The cup shape of part 74 conveniently provides clearance with the downstream end of nipple 22 when the parts are in the position of FIG. 2.

In the flow position shown in FIG. 2, liquid flows from the aperatures 24 in nipple 22 into and through the aerator 14 as indicated by the flow arrows. When in the second position, shown in FIG. 3, liquid flows from the apertures 24 into chamber 54, which is now much enlarged as compared to that chamber in FIG. 2, and discharges from chamber 54 through spray flow apertures 58.

Figure 4:
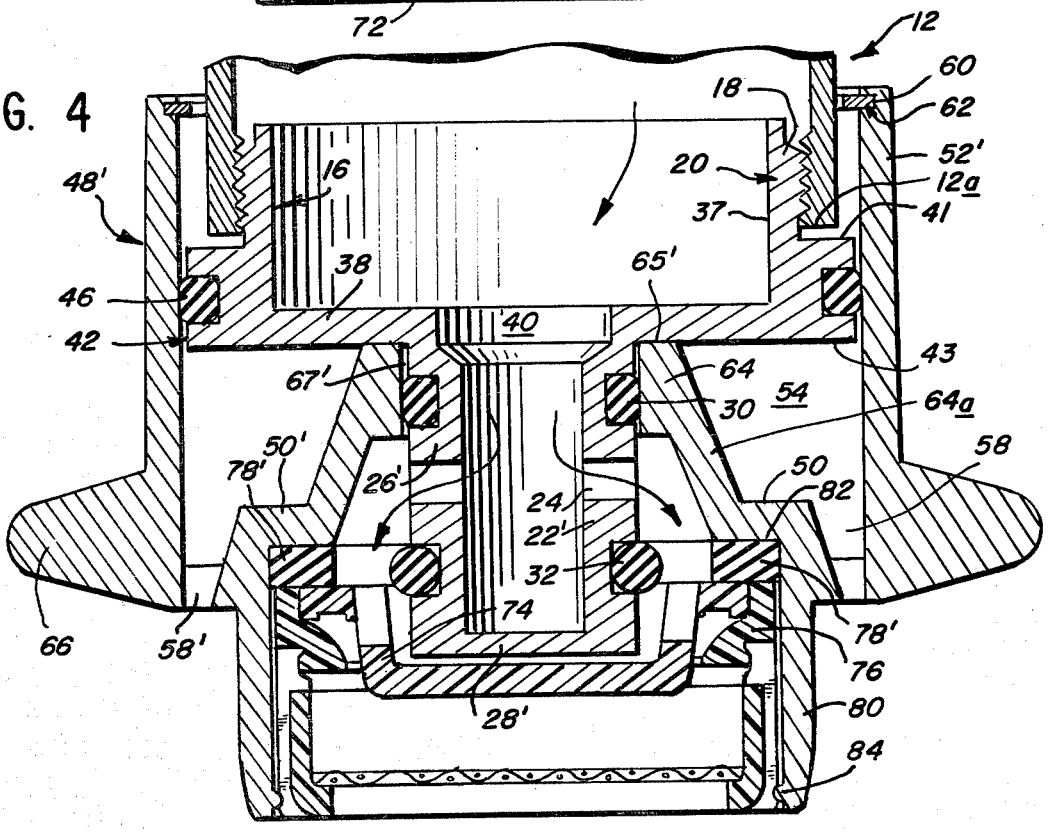
FIG. 4 is a vertical cross-sectional view similar to FIG. 2 showing details of a second embodiment of the invention.

FIG. 4 shows a second embodiment of this invention, wherein the body member 48' is in a flow position generally corresponding with FIG. 2, but with portions of a modified form of body member 48' modified to include, at the downstream end thereof, a casing for the aerator rather than an attachment sleeve as in FIGS. 2 and 3 to which an aerator may be selectively attached.

More specifically, in FIG. 4, the nipple 22' of the adapter 16' is elongated, the body member 48' is provided with an elongated upstream extending sleeve 52', the radial extent of transverse wall 50' on body member 48' is reduced, and the upstream extending inner sleeve 64' connects to transverse wall 50' through a frustro conical intermediate wall **64*a*. Also, extending downstream from transverse wall 50' there is a sleeve 80. The radial width of transverse wall 50' is such as to provide a seat 82 against which the rubber sealing washer 78' seats and the internal structure of the aerator, as shown in U.S. Pat. No. 3,654,191, is assembled in sleeve 80 by entry through the downstream opening of sleeve 80 and is retained in position by a retention rib 84 formed in the inner periphery of sleeve 80** adjacent the downstream end of that sleeve.

The operation of the FIG. 4 embodiment corresponds with the general operation described in connection with the FIG. 2 embodiment and will be understood from the description of operation of the FIG. 2 embodiment.

While there has been disclosed two forms of the invention, it will be understood that the invention may be utilized in other forms and environments, so that the purpose of the appended claims is to cover all such forms of devices not disclosed but which embody the invention disclosed herein.

What is claimed is:

1. In a faucet attachment for selectively discharging water therefrom in one of two alternate ways, the improvement comprising, in combination:

an adapter for securement to a liquid outlet and shaped to provide an upstream, large diameter, head portion and a downstream, smaller diameter, nipple portion, said nipple portion being axially elongated with flow passageway means provided from said adapter through only the longitudinal wall of said axially elongated nipple;

two axially spaced annular nipple seal means carried on said nipple and extending radially outwardly of the longitudinal wall of said nipple and spaced respectively upstream and downstream of said flow passageway means;

an annular head portion seal means on the head portion of the adapter extending radially outwardly of said head portion;

a molded body member operatively associated with said adapter for selectively directing water that issued from the flow passageway means of the adapter's nipple along alternate paths one of which includes a flow chamber bounded in part by said adapter, said body member including an annular, axially elongated, outer sleeve whose inner diameter is of a dimension to circumferentially engage and sealingly compress the annular head portion seal means of the adapter while permitting sliding movement of said outer sleeve relative to said head portion seal means;

an annular radially elongated wall molded integral with and extending inwardly from said outer sleeve and forming therethrough adjacent its junction with the outer sleeve, a series of flow-through apertures defining one alternate path for water issuing from the body member, said radially elongated annular wall defining at its inner edge an axially elongated inner sleeve, concentric with said outer sleeve but of lesser axial length, the inner diameter of said inner sleeve being of a dimension to circumferentially engage and sealingly compress one of the nipple seal means, the axial length of the inner sleeve being selected and shaped so that when said inner sleeve sealingly engages the upstream one of the nipple seal means, there exists downstream of the radially elongated wall the other alternate path for water issuing from the body member; and two means on the body member for cooperation with the head portion of the adapter for limiting the axial movement of the body member in both axial directions relative to the adapter.

2. A construction as in claim 1 wherein an annular attachment sleeve is molded integral with the radially elongated wall spaced radially inwardly of said flow-through apertures, and projecting downstream from said radially elongated wall, attachment means defined on said attachment sleeve, an aerator operatively associated with the other alternate path for water and being retained on said body member through said attachment means on said attachment sleeve, and an annular seal compressed between said aerator and an annular portion of said body member.

3. A construction as in claim 1 wherein a first one of said two means is an inwardly extending member carried by the outer sleeve and positioned to engage a radial outermost portion of the head portion of the adapter to limit movement of the body member relative to the adapter in a downstream direction.

4. A construction as in claim 1 wherein a second one of said two means is an axially upstream extending portion of the inner sleeve.

5. A construction as in claim 1 wherein said first one of said two means is a split ring.

* * * * *